US011541406B2

(12) United States Patent
Pelletier et al.

(10) Patent No.: US 11,541,406 B2
(45) Date of Patent: Jan. 3, 2023

(54) SPRAY NOZZLE

(71) Applicant: Sulzer Mixpac AG, Haag (CH)

(72) Inventors: Ryan Pelletier, Litchfield, NH (US); Hayden Turner, Ayer, MA (US); Robert Lindsey, Pelham, NH (US)

(73) Assignee: MEDMIX SWITZERLAND AG, Haag (CH)

( * ) Notice: Subject to any disclaimer, the term of this patent is extended or adjusted under 35 U.S.C. 154(b) by 0 days.

(21) Appl. No.: 16/834,001

(22) Filed: Mar. 30, 2020

(65) Prior Publication Data

US 2021/0299685 A1 Sep. 30, 2021

(51) Int. Cl.
*B05B 7/04* (2006.01)
*B05B 7/10* (2006.01)

(52) U.S. Cl.
CPC ..... *B05B 7/0483* (2013.01); *B05B 7/10* (2013.01)

(58) Field of Classification Search
CPC ..... B05B 7/0483; B05B 7/10; B05B 7/025
USPC ..... 239/423–424.5, 432, 433
See application file for complete search history.

(56) References Cited

U.S. PATENT DOCUMENTS

| | | | | |
|---|---|---|---|---|
| 5,553,783 | A | 9/1996 | Slavas et al. | |
| 6,994,276 | B2 * | 2/2006 | Faye | H01M 8/04089 239/421 |
| 7,036,753 | B2 | 5/2006 | Huffman | |
| 7,108,203 | B2 | 9/2006 | Huffman et al. | |
| 7,762,476 | B2 | 7/2010 | Micheli | |
| 9,168,545 | B2 | 10/2015 | Vidusek et al. | |
| 10,201,794 | B2 | 2/2019 | Lacroix | |
| 2014/0048615 | A1 | 2/2014 | Wurz | |
| 2016/0199805 | A1 * | 7/2016 | Lacroix | B01J 8/1818 239/424.5 |
| 2019/0076861 | A1 | 3/2019 | Gunn | |

FOREIGN PATENT DOCUMENTS

EP 3015173 A1 5/2016

* cited by examiner

*Primary Examiner* — Christopher S Kim
(74) *Attorney, Agent, or Firm* — Global IP Counselors, LLP

(57) ABSTRACT

A spray nozzle for spraying material includes an outlet, a mixing section, an inlet for the material, and a buffer space for pressurized gas. The mixing section is in fluid communication with the outlet. The inlet is in fluid communication with the mixing section. The buffer space is in fluid communication with the mixing section via two or more separate gas supply channels. The inlet comprises a separating wall configured to divide a flow of material to be sprayed into two separate flow passages prior to entry into the mixing section.

23 Claims, 6 Drawing Sheets

SPRAY NOZZLE

BACKGROUND

Field of the Invention

The present invention generally relates to a spray nozzle for spraying fluid material. In particular, the present invention relates to a spray nozzle configured to divide a flow of material into two separate flow passages prior to entering a mixing section configured to receive pressurized gas.

Background Information

Conventional spray mixers include a mixing device with a spray nozzle attached to an end thereof, a hose for pressurized gas, and an elbow between the hose and the spray nozzle. As a compound exits the mixing device it enters the spray nozzle and combines with the pressurized gas that passes from the hose through the elbow and into the spray nozzle. The spray nozzle, along with the pressurized gas, then sprays the compound on a surface or other structure.

SUMMARY

It is an object of the present disclosure to create a spray nozzle capable of spraying at comparatively high flow rates and which the amount of overspray, i.e. the amount of material sprayed which does not reach the desired spray target, is reduced, particularly for spray targets having a comparatively large surface area. It is a further object to make available a spray nozzle that can be manufactured in an expedient and cost-effective manner.

This object is satisfied by a spray nozzle having the features defined in claim 1. It has been discovered that an improved spray nozzle for a dispensing device is desired. In view of the state of the known technology, a first aspect of the present disclosure is to provide a spray nozzle for spraying material. The spray nozzle comprises an outlet, a mixing section, an inlet for the material, and a buffer space for pressurized gas. The mixing section is in fluid communication with the outlet. The inlet is in fluid communication with the mixing section. The buffer space is in fluid communication with the mixing section via two or more separate gas supply channels. The inlet comprises a separating wall configured to divide a flow of material to be sprayed into two separate flow passages prior to entry into the mixing section.

Through use of such a spray nozzle, an improved spray nozzle capable of spraying at comparatively high flow rates is obtained. Moreover, an amount of overspray is reduced, particularly for spray targets having a comparatively large surface area.

In this connection it should be noted that a separate gas supply channel means that each channel is formed by an enclosed passage, for example, of tubular design, having an at least substantially cylindrical or cylindrical cross-section, with each channel being arranged separate from the other one(s) of the two or more separate gas supply channels. Through the provision of a separating wall, the material flowing through the nozzle can reduce the cross-section of the flow of material enabling more air to mix with the material simplifying the spray process.

In a second aspect of the present disclosure, which can be used in combination with the first aspect, the separating wall comprises an enlarged central section. In this way, a flow influencing element is arranged in the flow path of the inlet in order to manipulate a flow of material passing through the inlet prior to the mixing section. Moreover, the enlarged central section, i.e. the flow influencing element or divider at the tail can cause the flow of material entering the mixing section to form a donut shape (when viewed in cross-section). Such donut shapes make it easier for the gas, i.e. air, to mix with the flow of material, since it breaks it up because the cross section of the flow of material is reduced, thereby the surface area of the fluid is increased, the velocity is also increased, and this allows the use of much less air pressure to properly atomize the high velocity material.

In a third aspect of the present disclosure, which can be used in combination with the first or second aspects, the separating wall is aligned with the two or more separate gas supply channels. In this connection it should be noted that aligned is to be understood such that a longitudinal axis of the spray nozzle, which passes through the separating wall and gas supply channel axes which extend through each separate gas supply channel intersect within a common region, more specifically at a common point. In this way a gas supplied via the gas supply channels and the flow of material passing through the inlet can be merged to interact within a common region forming the mixing section of the spray nozzle.

In a fourth aspect of the present disclosure, which can be used in combination with any of the first through third aspects, the enlarged central section of the separating wall is aligned with the two or more separate gas supply channels. This further improves the mixing results of mixing the gas and the material to be sprayed in the spray mixer improving the spray pattern.

In a fifth aspect of the present disclosure, which can be used in combination with any of the first through fourth aspects, the spray nozzle includes a longitudinal axis extending between the inlet, the mixing section and the outlet, and the separating wall and the two or more separate gas supply channels are aligned with the longitudinal axis.

In a sixth aspect of the present disclosure, which can be used in combination with any of the first through fifth aspects, the spray nozzle includes a longitudinal axis extending between the inlet, the mixing section and the outlet, and the enlarged central section of the separating wall and the two or more separate gas supply channels are aligned with the longitudinal axis. This yields further improved spray mixing results achievable with the spray nozzle.

In a seventh aspect of the present disclosure, which can be used in combination with any of the first through sixth aspects, the two or more separate gas supply channels are inclined with respect to the longitudinal axis. In this connection it should be noted that an angle of inclination between the gas supply channels and the longitudinal axis can be selected in the range of 10 degrees to 70 degrees, preferably in the range of 15 degrees to 60 degrees, and most preferably in the range of 20 degrees to 60 degrees.

In an eighth aspect of the present disclosure, which can be used in combination with any of the first through seventh aspects, the enlarged central section, at least over 20% of its length, has an at least substantially cylindrical outer shape or a cylindrical outer shape except at those points where the web connects to the enlarged central section.

In a ninth aspect of the present disclosure, which can be used in combination with any of the first through eighth aspects, the enlarged central section has an at least substantially bullet-like shape. Preferably, a head or a tip of bullet faces away from the outlet and has a rounded outer shape. Through the use of such a design of the enlarged central section particularly good manipulations of the flow of material can be achieved which once combined with the gas flow lead to particularly good spraying results.

In a tenth aspect of the present disclosure, which can be used in combination with any of the first through ninth aspects, the separating wall includes two webs extending between a wall surrounding the inlet and the enlarged central section. Through the use of such webs of material a manufacture of the spray nozzle can be simplified and thereby reduced in cost.

In an eleventh aspect of the present disclosure, which can be used in combination with any of the first through tenth aspects, the mixing section has an at least substantially cylindrical outer shape over at least a part of its length between the outlet and the inlet. In this connection it should be noted that the inlet likewise has an at least substantially cylindrical outer shape. This means the inlet may be cylindrical in outer shape where no webs attach to the inner walls of the inlet.

In a twelfth aspect of the present disclosure, which can be used in combination with any of the first through eleventh aspects, the outlet includes an outlet opening having an elongate shape with an elongate extent. In this connection it should be noted that forming the outlet from the spray nozzle in this way enables a confinement of the spray pattern to provide a more uniform cone spray that makes application of the materials to be sprayed easier. Prior art spray nozzles typically have no form of directional control and hence cannot reduce an overspraying. An outlet shaped in this way allows operators to apply material right up the edges of the intended work surface without getting much on adjacent surfaces.

In a thirteenth aspect of the present disclosure, which can be used in combination with any of the first through twelfth aspects, the outlet tapers from the outlet opening to the mixing section.

In a fourteenth aspect of the present disclosure, which can be used in combination with any of the first through thirteenth aspects, the outlet continuously tapers in size between the outlet opening and the mixing section.

In a fifteenth aspect of the present disclosure, which can be used in combination with any of the first through fourteenth aspects, the separating wall is arranged transverse to the elongate extent of the outlet opening. This means that the elongate extent of the outlet opening is arranged at least substantially perpendicular or perpendicular to the separating wall.

In a sixteenth aspect of the present disclosure, which can be used in combination with any of the first through fifteenth aspects, the separating wall is arranged in a plane and two of the two or more separate gas supply channels are arranged in the same plane as the separating wall.

In a seventeenth aspect of the present disclosure, which can be used in combination with any of the first through sixteenth aspects, two of the two or more separate gas supply channels are arranged in a plane transverse to a plane in which the separating wall is arranged.

In an eighteenth aspect of the present disclosure, which can be used in combination with any of the first through seventeenth aspects, the inlet is configured to receive a portion of an outlet from a cartridge. This outlet can be present in the form of a housing of a static or dynamic mixer, a nozzle attachable to the cartridge, or directly at the cartridge, if a one-component material is to be sprayed with the spray nozzle.

In a nineteenth aspect of the present disclosure, which can be used in combination with any of the first through eighteenth aspects, the buffer space is in fluid communication with a gas supply connector.

In a twentieth aspect of the present disclosure, which can be used in combination with any of the first through nineteenth aspects, the buffer space is the only buffer space for the pressurized gas, preferably between the gas supply connector and the respective gas supply channels.

In a twenty-first aspect of the present disclosure, which can be used in combination with any of the first through twentieth aspects, the spray nozzle includes an inner component and an outer component, and the buffer space is disposed between the inner component and the outer component.

In a twenty-second aspect of the present disclosure, which can be used in combination with any of the first through twenty-first aspects, the spray nozzle further includes alignment ribs on at least one of an outer surface of the inner component and an inner surface of the outer component, the alignment ribs configured to cooperate with at least one corresponding element on the other one of the inner component and the outer component.

In a twenty-third aspect of the present disclosure, which can be used in combination with any of the first through twenty-second aspects, at least a part of each gas supply channel is disposed in each of the inner component and the outer component.

BRIEF DESCRIPTION OF THE DRAWINGS

Referring now to the attached drawings which form a part of this original disclosure.

DETAILED DESCRIPTION OF EMBODIMENTS

Selected embodiments will now be explained with reference to the drawings. It will be apparent to those skilled in the art from this disclosure that the following descriptions of the embodiments are provided for illustration only and not for the purpose of limiting the invention as defined by the appended claims and their equivalents.

Figure 1:
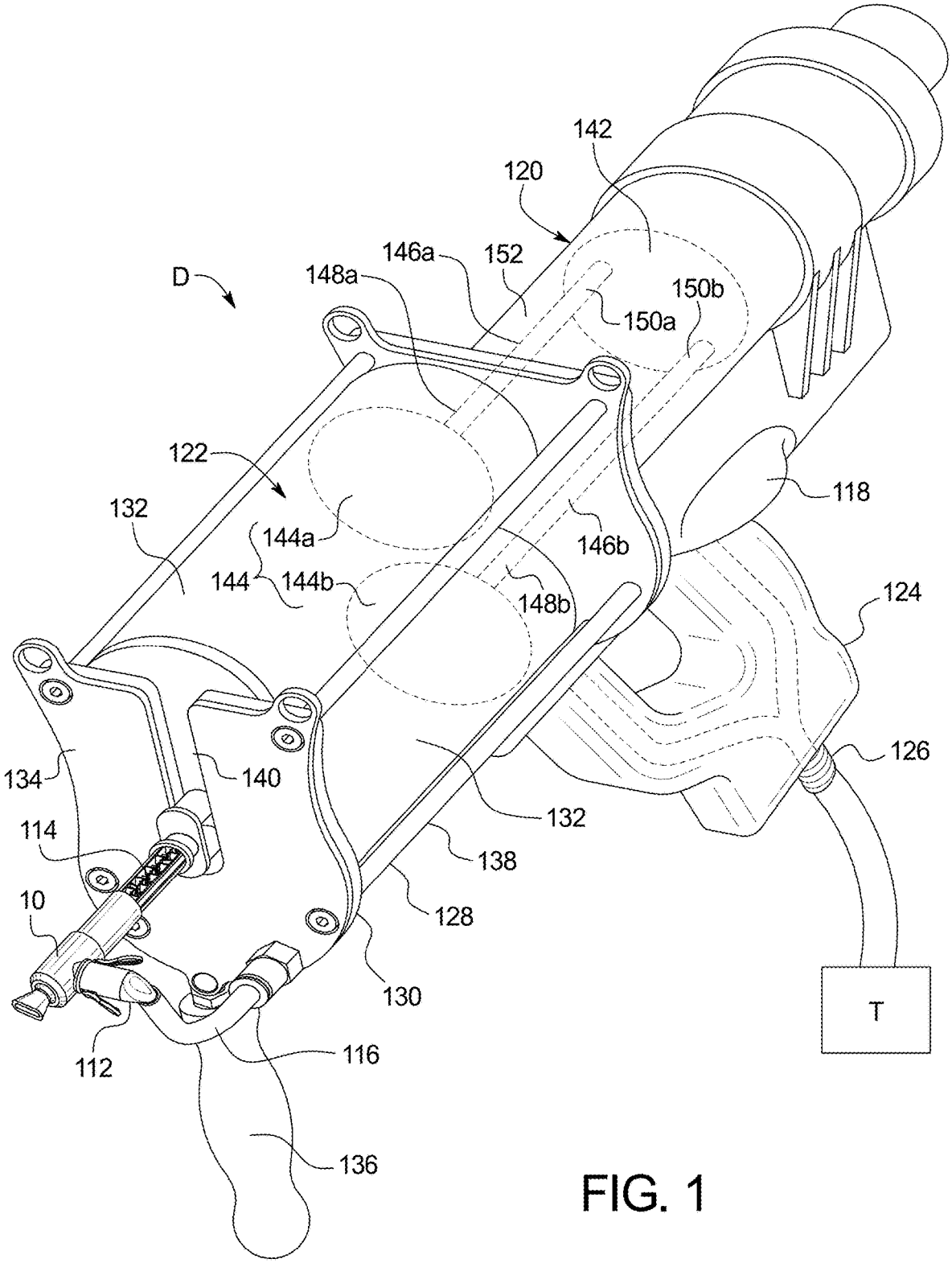
FIG. 1 is a front perspective view of a dispensing device which includes an example embodiment of a spray nozzle according to the present disclosure.
Figure 2:
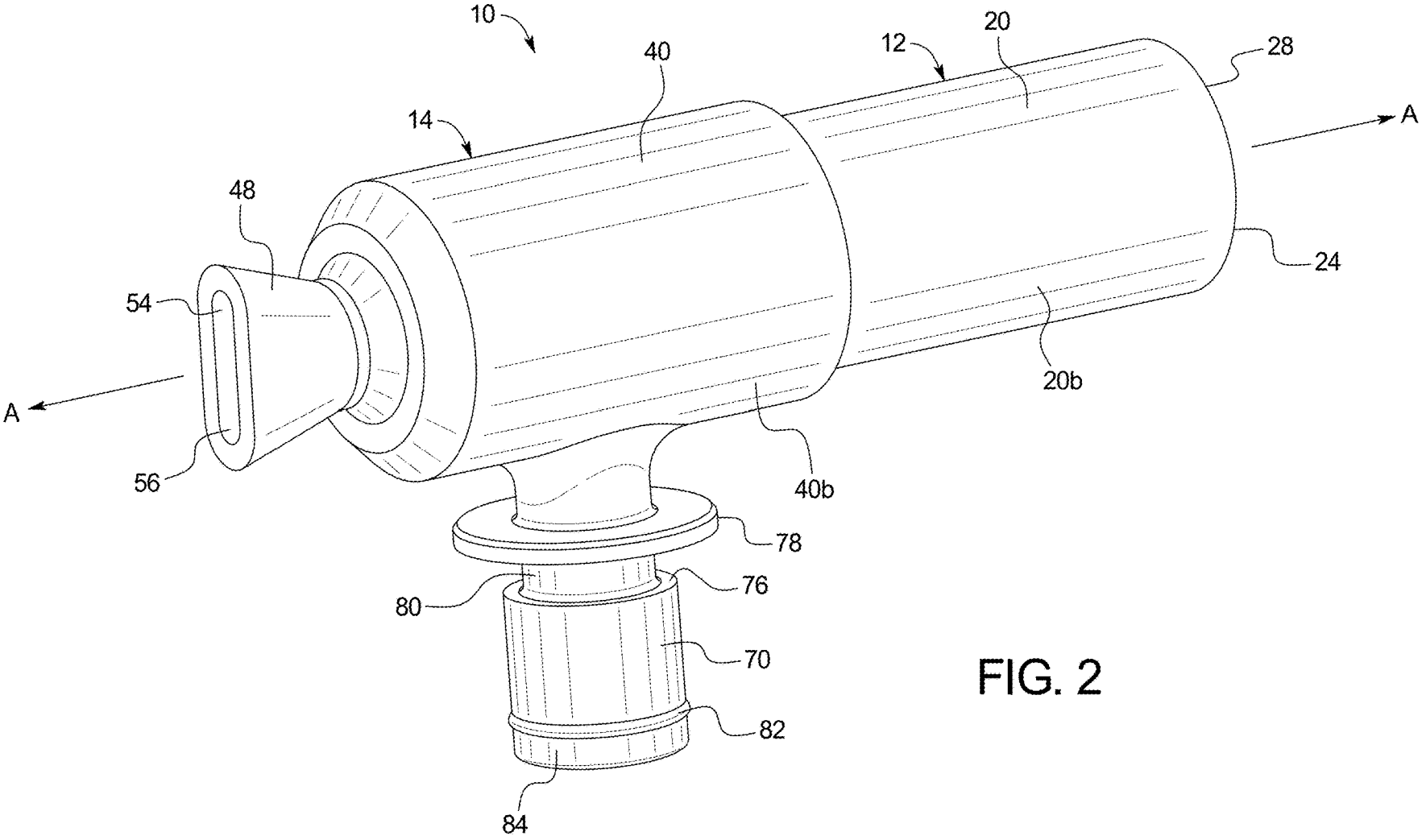
FIG. 2 is a top perspective view of the spray nozzle of FIG. 1.

Referring initially to FIG. 1, an example embodiment of a spray nozzle 10 is shown connected to a dispensing device or dispenser D. The spray nozzle 10 is configured to couple to an end of a mixer or mixing device 114 and a connecting device 112 with a pressurized gas hose 116. Thus, as can be understood, the spray nozzle 10 is disposed between the mixer or mixing device 114 and the connecting device 112 of the dispenser D.

The dispenser D can be a spray mixer for the mixing and dispensing of at least two components. That is, the dispenser D can be for a multi-component industrial coating packaging system for use in simultaneously dispensing coatings in one easy step. In this connection it should be noted that also single component coatings could be dispensed using the dispenser D if the dispenser D is configured for dispensing single component materials.

Preferably, the coatings are single-component or multi-component, reactive, high-solids low-VOC paints. More preferably, the coatings are single-component or multi-component, reactive, high-solids low-VOC marine, military, and industrial paints. The spray nozzle 10 in use with the dispenser D desirably allows one to dispense or spray two component marine and industrial paints in one continuous step, preferably without having to pre-mix either component. As can be understood, the dispenser D allows dispensing of the exact amount of marine, military, and industrial paints while reducing or eliminating the mixer's or painter's exposure to unnecessary hazardous materials, reduces the amount of hazardous waste in application, disposal and clean up, and reduces the amount of VOC's released into the environment. The dispenser D eliminates the need to open and premix coatings, eliminates the need to manually pre-measure coatings into exact ratios for use, significantly reduces waste and generation of excess coating, and provides a direct delivery method for marine and industrial coating by spraying the coating onto the surface to be coated.

As shown in FIG. 1, the dispenser includes a housing 118, a drive unit 120, and a material dispenser 122. The housing 118 includes a handle 124 for gripping by an operator for operating the dispenser D to dispense material. The handle 124 can include a trigger switch or trigger (not shown) and a pressurized fluid control dial (not shown). The housing 118 accommodates the drive unit 120. At the bottom of the housing 118, a pressurized gas inlet 126 is disposed. The pressurized gas inlet 126 connects to a tank T of pressurized gas, for example pressurized air.

A holder 128 is disposed at a front end 130 of the housing 118 to receive a receptacle 132 (or a plurality of receptacles) for material to be dispensed. Thus, the holder 128 defines the front end of the dispenser D. The holder 128 includes a front plate 134, a handle 136 and a pressurized gas line 138. The front plate 134 includes an opening 140 to enable the nozzle of the cartridges 132 to extend therethrough. The opening 140 can be generally U-shaped to enable ease of insertion of the cartridges 132; however, the opening 140 can be any suitable shape. The handle 136 enables a user to grip and control the front end of the dispenser D. This two-hand operation enables better stability and control for the user. The fluid line connects the pressurized gas line 138 to the pressurized gas inlet 126 through the housing 118 and the hose 116.

The cartridges 132 can be any type of receptacle for material, e.g. cartridge type or sausage type, which are types well known in the art, or any other suitable type of receptacle. The material can be any type of coating or paint. For example, the coating can be any ordinary solvent-based coating or high solid, edge retentive coating for construction and repair. Additionally, the material can be a multi-component, high solid paint that cures a chemical reaction that creates heat after mixing. The material can also be or include an adhesive.

The drive unit 120 can include at least one plunger 142 and the material dispenser 122 can include at least one material dispenser (shuttle) 144. In one embodiment, the material dispenser 144 includes a first shuttle 144*a* and a second shuttle 144*b*, with each of the shuttles being a plunger configured to be inserted into a respective cartridge 132 or receptacle. Each shuttle 144*a* and 144*b* is connected to a respective rod 146*a* and 146*b* at a first end 148*a* and 148*b* of the rods 146*a* and 146*b* so to be capable of driving the material dispenser 144 along the holder 128. The second end 150*a* and 150*b* of each rod 146*a* and 146*b* is connected to the piston 142 in the drive unit 120. As can be understood, the shuttles 144*a* and 144*b* are configured to drive and dispense the materials in a respective cartridge 132. Although the shuttles 144*a* and 144*b* are illustrated as plungers, the shuttles 144*a* and 144*b* can be any suitable devices.

Since the first and second shuttles 144*a* and 144*b* are connected to the piston 142, the first and second shuttles 144*a* and 144*b* move in unison. The dispenser D shown is generally used with a side-by-side cartridge 132. That is, the cartridge contains two cartridges 132 adjacent each other such that the first and second shuttles 144*a* and 144*b* can be disposed within adjacent cartridges 132 and dispense separate materials simultaneously. The materials are then typically guided through the mixing device 114, such as a static or dynamic mixer, where the materials are mixed prior to exiting from the mixing device 114. Such a system enables materials to thoroughly mix and form an adhesive or mixed material right before or as they are being applied to a surface or area. However, it is noted that the dispenser D can be used with a cartridge or container containing a co-axial container of viscous materials. That is, a cartridge 132 containing two components of viscous material arranged coaxially in the container and separated by an annular partition inside the container. In the coaxial container, the two separate materials are dispensed from their respective containers into a mixer prior to being applied to the specific surface or area.

Moreover, as desired, the dispenser D can be used with a single cartridge having only one component (of viscous material or any other suitable container). The spray nozzle 10 would then not be connected to a mixing device 114, but either directly to the outlet of a cartridge (not shown) or another element such as a dispensing nozzle (also not shown) connectable between the outlet of the cartridge and the spray nozzle 10.

The drive unit 120 includes a compartment 152 that is configured to be pressurized by the pressurized gas from the tank T. The plunger 142 is sealingly disposed inside the compartment and upon the operation of the trigger, the pressurized gas is communicated into the compartment 152 to drive the plunger 142. The plunger 142 moves along the compartment 152, which in turn moves the first and second shuttles 144*a* and 144*b* via the rods 146*a* and 146*b*.

FIGS. 2 to 6 illustrate the spray nozzle 10 in detail. In the illustrated embodiment, the spray nozzle 10 includes a first or inner component 12 and a second or outer component 14. In use, the first or inner component 12 is configured to attach to the mixing device 114 or to another form of outlet (e.g., via a snap fit using mating feature 65 discussed below). Once attached to mixing device 114 or to another form of outlet, the first or inner component 12 and the second or outer component 14 are configured to mix a material received from mixing device 114 and dispense the material as a spray via an outlet 48 which is designed to operate with high flow rates of material and cause little to no overspray, enabling efficient and uniform application of sprayable material to a large area. It should be understood by those of ordinary skill in the art that several of the features described herein with respect to the first or inner component 12 (hereinafter "first component 12") can be formed on the second or outer component 14 (hereinafter "second component 14"), and that several of the features described herein with respect to the second component 14 can be formed on the first component 12.

In the illustrated embodiment, at least a portion of the first component 12 is sized and shaped to slide within and mate with or couple to the second component 14 along a longitudinal axis A to form the spray nozzle 10. In alternative embodiments, the features of the first component 12 and/or the second component 14 can be incorporated into a single component or formed on additional attachable components. Moreover, the first component 12 can be permanently or semi-permanently mated with or attached to the second component 14 in any manner desired.

Alternative embodiments can also result in the second component 14 at least partially entering an aperture formed by the first component 12, in some cases making second component 14 the "inner" component and first component 12 the "outer" component.

In the illustrated embodiment, the first component 12 includes a first outer wall 20 which extends along a central longitudinal axis A from a first end 22 with a first opening 23 to a second end 24 with a second opening 25. The first outer wall 20 can include an inner surface 20*a* and an outer surface 20*b*. As illustrated, the first outer wall 20 can encircle longitudinal axis A between the first end 22 and the second end 24 such that the inner surface 20*a* forms the outer periphery of a passage 26 between the first end 22 and the second end 24. The passage 26 is configured to place the first opening 23 in fluid communication with the second opening 25.

As illustrated, the diameter of passage 26 can vary along longitudinal axis A, dividing the first component 12 into multiple segments between the first end 22 and the second end 24. In an embodiment, the first component 12 includes a first or separating segment 12*a* located proximal to the first end 22 and aligned with a separating wall 30, a second or tapered segment 12*b* gradually increasing and/or decreasing the diameter of the passage 26 along longitudinal axis A, and a third or generally straight segment 12*c* located proximal to the second end 24. The separating segment 12*a* can form a first cylindrical portion 26*a* of the passage 26; the tapered segment 12*b* can form a conical portion 26*b* of the passage 26; the straight segment 12*c* can form a second cylindrical portion 26*c* which forms an inlet 28 for passage 26. Those of ordinary skill in the art will recognize that the shapes and sizes of the segments 12*a*, 12*b* and 12*c* can vary and that more or less segments can be formed by the first component 12 along longitudinal axis A.

In the illustrated embodiment, the separating segment 12*a* includes a separating wall 30 which divides the passage 26 into a first flow passage 32 and a second flow passage 34 at or near first end 22. As illustrated, the separating wall 30 can extend between opposite sides of the inner surface 20*a* of the first outer wall 20, for example, so that the first flow passage 32 and the second flow passage 34 are approximately equally or identically sized and shaped. In use, the separating wall 30 is configured to divide a flow of material which enters the passage 26 at the inlet 28 into two separate flow passages prior to entering a mixing section 52 (discussed below).

In this connection it should be noted that the difference in diameter between the segments 12*b* and 12*c* may be selected such that when the nozzle 10 is connected to a mixing device 114, having a housing, that the housing wall thickness corresponds at least substantially to this difference in diameter, so that a flow path between the mixing device 114 and the inlet has as few dead zones as possible which could negatively influence the flow behavior of the material coming from the mixing device 114 and entering the separating segment 12*a*.

Figure 3:
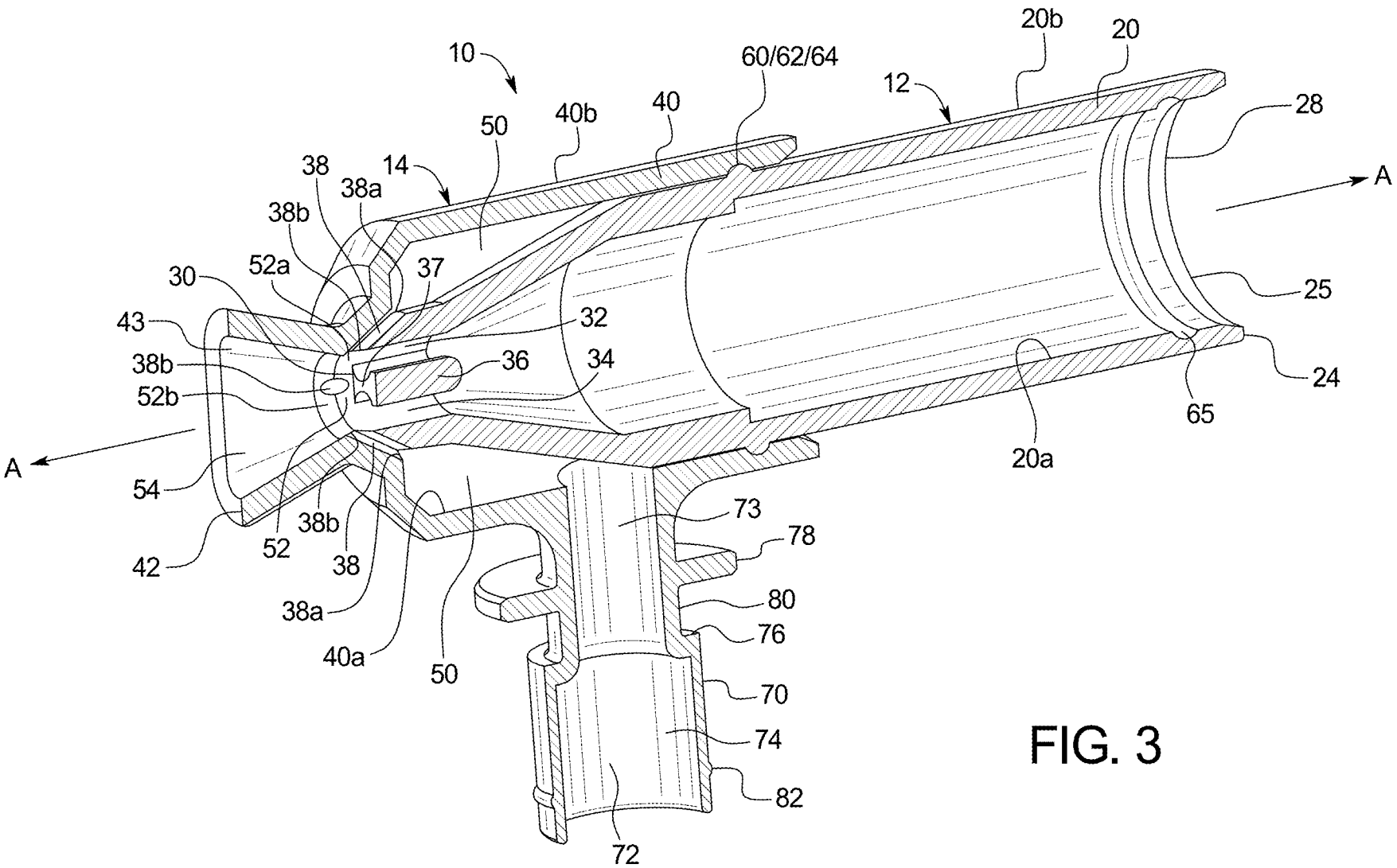
FIG. 3 is a top cross-sectional perspective view of the spray nozzle of FIG. 1.
Figure 4:
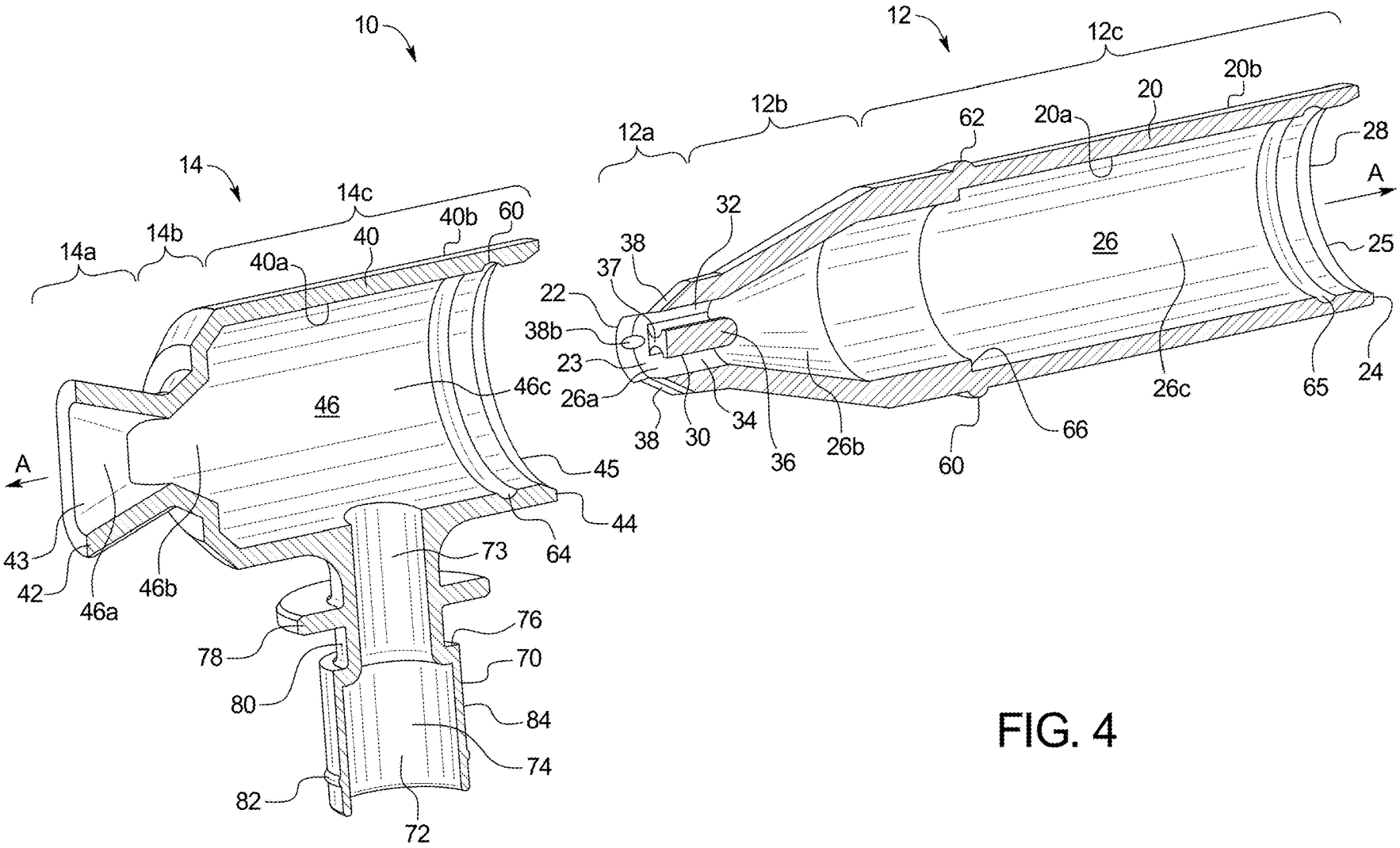
FIG. 4 is an exploded top cross-sectional perspective view of the spray nozzle of FIG. 1.

In the illustrated embodiment, the separating wall 30 includes an enlarged central section 36 which projects radially outwardly at or near a central point between two webs 37 attaching the enlarged central section 36 to opposite sides of the inner surface 20*a*. The separating wall 30 including the two webs 37 on opposite sides of the enlarged central section 36 can extend, for example, between the same outer wall 20 surrounding inlet 28. As illustrated in FIGS. 3 and 4, the webs 37 can be thinner in height than the enlarged central section 36 in a direction perpendicular to the direction that separating wall 30 extends between opposite sides of the inner surface 20*a*, for example, by bowing the top and/or bottom of the webs to create concave surfaces as shown.

In an embodiment, the enlarged central section 36 can include an at least substantially cylindrical outer shape, for example, with the central axis of the cylindrical outer shape located along longitudinal axis A. In another embodiment, the enlarged central section 36 can include an at least substantially bullet-like shape, for example, with the central axis located along longitudinal axis A and the tip of the bullet-like shape facing towards the second end 24 of the first component 12. Those of ordinary skill in the art will recognize that other shapes and sizes besides the embodiment shown can also be suitable to divide the passage 26 into a first flow passage 32 and a second flow passage 34. For example, in alternative embodiments, the bullet-like shape of the enlarged central section 36 can be replaced or supplemented, for example, by a rounded or pointed tip, a serrated shape or surface, a scalloped shape or surface, a fluted shape or surface, a mesh shape or surface, or another shape or surface. In another alternative embodiment, the separating wall 30 can form more than two flow passages through the separating segment 12*a* (e.g., additional webs 37 can create a third flow passage, a fourth flow passage, etc.).

Figure 6:
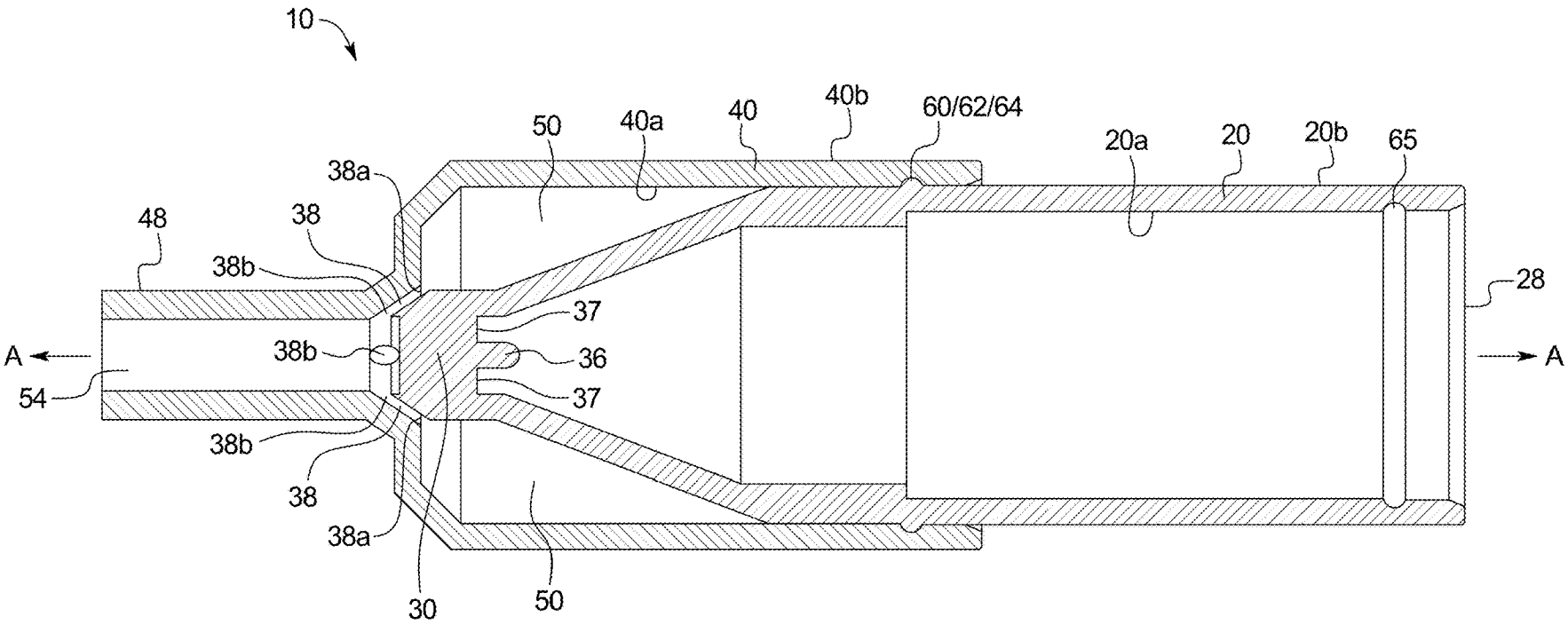
FIG. 6 is a side cross-sectional view of the spray nozzle of FIG. 1.

As illustrated in FIG. 6, the enlarged central section 36 can extend past the edge of the webs 37 in the direction towards the inlet 28 along longitudinal axis A. As illustrated, a length of the enlarged central section 36 can be longer than a length of the webs 37 in the direction of longitudinal axis A. By extending the enlarged central section 36 in this manner, the enlarged central section 36 can cause the material flowing through the passage 26 to form a donut shape as it passes into the first flow passage 32 and the second flow passage 34. This donut shape reduces the cross-section of the material through the passage 26, which increases the surface area and velocity through the first flow passage 32 and the second flow passage 34, enabling the use of less air pressure from one or more gas supply channels 38 to properly atomize the material at the mixing section 52. When the enlarged central section 36 has a bullet-like shape with a tip having a tapering diameter around longitudinal axis A, as shown in FIG. 6 for example, the bullet-like shape can cause the gradual formation of the donut shape as the material passes from the passage 26 to the first flow passage 32 and the second flow passage 34. Alternatively, a pointed tip or another shape gradually tapering or altering the size or shape at the end of the enlarged central section 36 can also cause the same effect of gradually forming the donut shape as the material passes from the passage 26 to the first flow passage 32 and the second flow passage 34.

Figure 5:
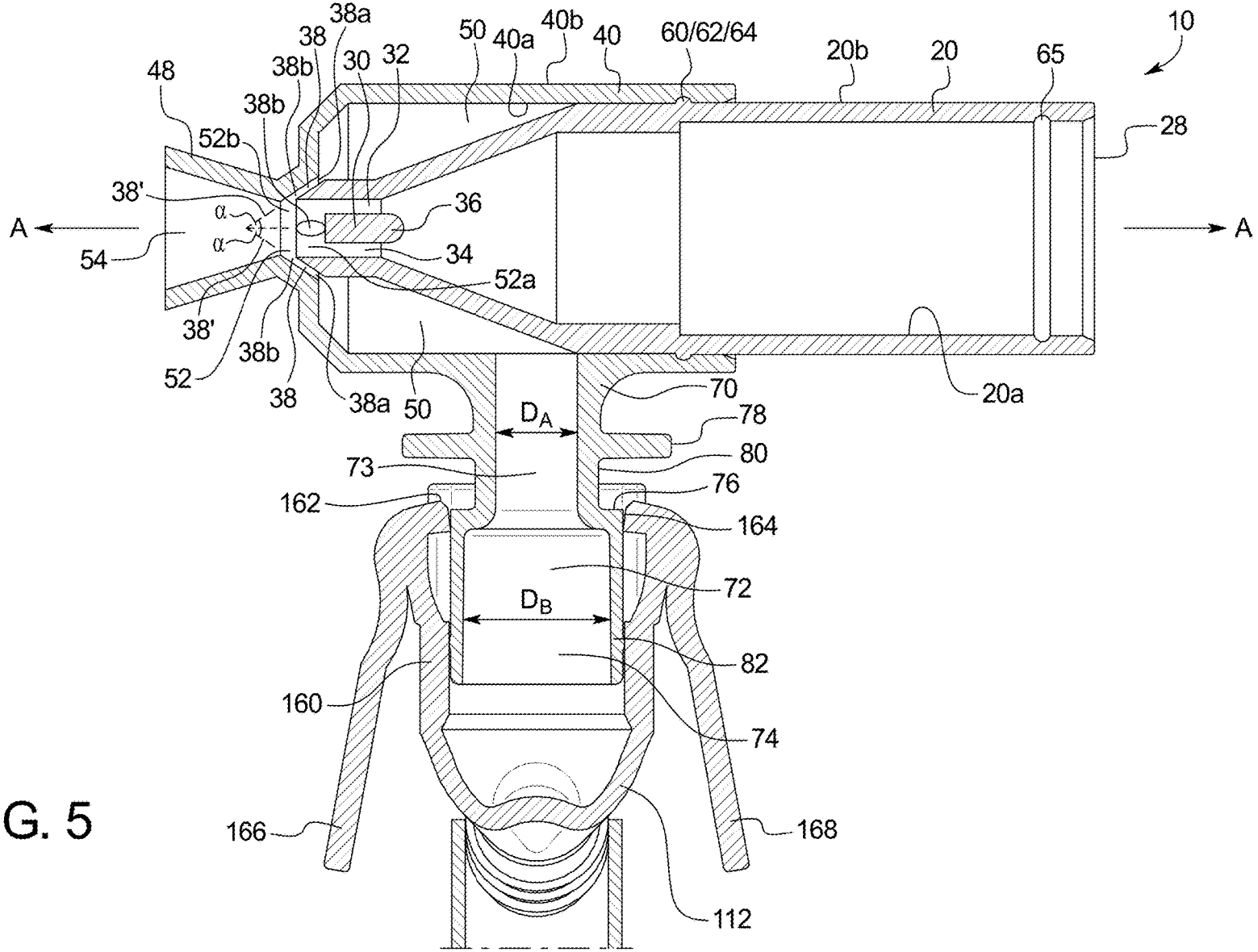
FIG. 5 is a top cross-sectional view of the spray nozzle of FIG. 1 connected to a connecting device.

The separating segment 12*a* can further include one or more gas supply channels 38 configured to enable pressurized gas to flow from outside of the first outer wall 20 into the passage 26. In the illustrated embodiment, four gas supply channels 38 are shown circling the passage 26 at 90-degree intervals at or near the first end 22. FIG. 5 shows two gas supply channels 38 aligned with the separating wall 30 on opposite sides of the first component 12 from a top view, while FIG. 6 shows two more gas supply channels 38 aligned with the separating wall 30 on opposite sides of the first component 12 from a perpendicular cross-sectional side view. In this embodiment, taking a plane through the center of the webs 37 of the separating wall 30 from one side of inner surface 20 to the other, two gas supply channels are arranged in the same plane as the separating wall 30, and two gas supply channels are arranged in a plane transverse to the plane through the center of the separating wall 30. In the illustrated embodiment, the transverse plane is perpendicular to the plane through the separating wall 30, though other angled configurations are also possible. Those of ordinary skill in the art will recognize that there can be multiple ways to configure the gas supply channels 38 around the perimeter of the first component 12 and/or at different spacings relative to the separating wall 30 and/or the mixing section 52 along longitudinal axis A. For example, in one embodiment the gas supply channels 38 can have a torsional configuration that would be capable of imparting a swirling motion to the air passing therethrough.

As illustrated, the tapered segment 12*b* can form a conical portion 26*b* which reduces the volume of the passage 26 along longitudinal axis A in the direction from the second end 24 to the first end 22 of the outer wall 20. The outer wall 20 can have a substantially constant slope between the straight segment 12*c* and the separating segment 12*a* to reduce the volume of the passage 26 leading into the separating segment 12*a*. In an embodiment, the volume can be reduced by half or more over the length of the tapered segment 12*b*. This reduction in volume not only enables the first end 22 of the first component 12 to slide inside the second component 14 such that the first end 22 abuts the outer wall 40 of the second component 14 to create a buffer space 50, but also increases the speed of mixed material flowing from the mixing device 114 through the passage 26 and into the separating segment 12*a*, thus increasing the velocity of the flow of the material through the separating segment 12*a* to outlet 48 to be sprayed and enabling the use of less air pressure from one or more gas supply channels 38 to properly atomize the material at the mixing section 52.

In the illustrated embodiment, the second component 14 includes a second outer wall 40 which extends along longitudinal axis A from a first end 42 with a first opening 43 to a second end 44 with a second opening 45. The second outer wall 40 can include an inner surface 40*a* and an outer surface 40*b*. As illustrated, the second outer wall 40 can encircle longitudinal axis A between the first end 42 and the second end 44 such that the inner surface 40*a* forms the outer periphery of a passage 46 between first end 42 and second end 44, wherein the passage 46 places the first opening 43 in fluid communication with the second opening 45.

As illustrated, the diameter of the passage 46 can vary along longitudinal axis A, dividing the second component 14 into multiple segments between the first end 42 and the second end 44. In an embodiment, the second component 14 includes a first or outlet segment 14*a* configured to dispense mixed material via an outlet 48, a second or tapered segment 14*b* gradually increasing and/or decreasing the diameter of the passage 46 along longitudinal axis A, and a third or generally straight segment 14*c* located proximal to the second end 44 and configured to attach the second component 14 to the first component 12. The outlet segment 14*a* can form the outlet 48 from an outlet portion 46*a* of the passage 46 in which the outer wall 40 increases in distance along the longitudinal axis A taken from at least one view in the direction from the second end 44 to the first end 42 (e.g., taken from the top view in FIG. 3-5); the tapered segment 14*b* can form a conical portion 46*b* which increases or decreases the area of the passage 46 opposite to the outlet segment 14*a* in the direction of longitudinal axis A, and which is configured to mate with and/or overlap the separating segment 12*a* of the first component 12 when the first component 12 couples to the second component 14; the straight segment 14*c* can form a cylindrical portion 46*c* of the passage 46 which is configured to receive the first component 12 when the first component 12 couples to the second component 14. Those of ordinary skill in the art will recognize that the shapes and sizes of the segments 14*a*, 14*b* and 14*c* can vary and that more or less segments can be formed by the second component 14 along longitudinal axis A.

As illustrated, the outlet segment 14*a* of the second component 14 can include an outlet 48 configured to dispense material after mixing occurs within the spray nozzle 10. As illustrated, at least a portion of the outlet 48 can be formed by tapering the outer wall 40 radially outwardly from longitudinal axis A in the direction from the tapered segment 14*b* to the first end 42. In the illustrated embodiment, the outlet 48 includes an outlet opening 54 (e.g., formed by first opening 43) having an elongate shape with an elongate extent 56. The elongate extent 56 can form a slit, for example, with the outer wall 40 at the outlet segment 14*a* tapering radially outwardly in the direction from the tapered segment 14*b* to the first end 42 from a first view (e.g., FIG. 5), and with the outer wall 40 maintaining a substantially constant distance from longitudinal axis A along the length of the outlet segment 14*a* from a second or perpendicular view (e.g., FIG. 6). The shape of the outlet 48 with the elongate extent 56 is advantageous, for example, because the material exiting the outlet 48 creates a uniform cone spray which is easy to directionally control and apply to a surface, particularly at the edges of the surface without applying the material to an adjacent surface. The outlet 48 formed in the disclosed manner is designed to work with relatively high flow rates of material and has been found to cause little to no overspray, making the outlet 48 efficient for applying a spraying material such as an adhesive to a large area.

In the illustrated embodiment, the separating wall 30 is arranged transverse to the elongate extent 56 of the outlet opening 54, for example, by arranging the length of the separating wall 30 between opposite sides of the inner surface 20*a* to be approximately perpendicular to the longest length of the elongate extent 56. An advantage of this configuration, for example, can be to cause the mixed material to be swirled as it transfers through the outlet 48 and exits the spray nozzle 10.

FIGS. 2, 3, 5 and 6 illustrate the spray nozzle 10 once the first component 12 has been coupled to the second component 14. When combined, the second opening 25 of the first component 12 creates the inlet 28 for the constructed spray nozzle 10, the first opening 43 of the second component 14 creates the outlet 48 for the constructed spray nozzle 10, and the passages 26 and 46 place the inlet 28 in fluid communication with the outlet 48.

In the illustrated embodiment, the first component 12 can be coupled to the second component 14 by sliding the first end 22 of the first component 12 into the second opening 45 of the second component 14 until one or more mating feature 60 secures the first component 12 to the second component 14. In the illustrated embodiment, the one or more mating feature 60 includes at least one alignment rib 62 on the outer surface 20*b* of the first component 12 and/or the inner surface 40*a* of the second component 14. When the first component 12 is inserted into the second component 14, the one or more alignment rib 62 can mate with one or more corresponding element 64 (e.g., an indentation) on the other of the outer surface 20*b* of the first component 12 and/or the inner surface 40*a* of the second component 14. In the illustrated embodiment, the alignment rib 62 and the corresponding element 64 (e.g. indentation) fully encircle the respective outer surface 20*b* of the first component 12 and the inner surface 40*a* of the second component 14, but alternative embodiments with strategically placed mating features 60 can accomplish the same goal. It should further be understood that the first component 12 and/or the second component 14 can include one or more other mating feature 60 instead of or in addition to an alignment rib 62 and/or a corresponding element 64, for example, a snap-fit feature, a clamping feature, a press-fit feature, a screw/bolt feature, or another mating feature known in the art.

In an embodiment, the first component 12 can also include a mating feature 65 (e.g. an alignment rib 62, a corresponding element 64, or an alternative mating feature 60) on the inner surface 20*a* or the outer surface 20*b* of the first outer wall 20 near the second end 24 which is configured to enable the attachment of the spray nozzle 10 to a mixing device 114 as illustrated in FIG. 1. For example, the mating feature 65 can be configured to enable first component 12 to snap-fit to an outer surface of the mixing device 114. In an embodiment, at least a portion of an outlet of the mixing device 114 can be inserted into the second opening 25 at the second end 24, for example, until mating with a mating feature 65 and/or abutting a shoulder 66 formed on the inner surface 20*a* of the first outer wall 20. In an embodiment, the mixing device 114 can be a static mixer. In another embodiment, the spray device 10 can be attached to the outlet of a single component material device without the use of a static mixer.

As illustrated, the coupling of the first component 12 to the second component 14 causes the first end 22 of the first component 12 to abut the inner surface 40*a* of the second outer wall 40 of the second component 14 at the tapered segment 14*b*, which creates a buffer space 50 disposed between the first outer wall 20 of the first component 12 and the second outer wall 40 of the second component 14. More specifically, the coupling of the first component 12 to the second component 14 creates the buffer space 50 between the outer surface 20*a* of the tapered segment 12*a* of the first component 12 and the inner surface 40*a* of the tapered segment 14*b* of the second component 14. In the illustrated embodiment, the buffer space 50 encircles the outer surface 20*b* of first outer wall 20 and fluidly communicates with the passage 26 within the first component 12 via one or more gas supply channels 38. In an embodiment, the first end 22 of the first component 12 creates a fluid tight seal when contacting the inner surface 40*a* of the second component 14, such that the buffer space 50 can only fluidly communicate with the passage 26 through the first component 12 via the one or more gas supply channel 38.

In an embodiment, the coupling of the first component 12 to the second component 14 can form at least a portion of one or more gas supply channel 38, causing at least a part of each gas supply channel 38 to be disposed in each of the first component 12 and the second component 14. For example, one or more gas supply channels 38 can be initially formed as an indentation into the first outer wall 20 at the first end 22 of the first component 12. When the first end 22 of the first component 12 abuts the second outer wall 40 of the second component 14, the inner surface 40*a* of the second outer wall 40 can form at least a portion of a surface creating an aperture for one or more gas supply channels 38, with the indentation into the first outer wall 20 of the first component 12 forming the rest of the surface to create the aperture. Put another way, one or more gas supply channel 38 can include an aperture formed by the combination of the first component 12 and the second component 14. Alternatively, one or more gas supply channel 38 can include one or more aperture passing through the first outer wall 20 of the first component 12 without the need for the second component 14 to form part of the wall surrounding the aperture.

Each gas supply channel 38 can include an inlet 38*a* and an outlet 38*b*. The inlet 38*a* can be located at the outer surface 20*b* where the gas supply channel 38 meets the buffer space 50. The outlet 38*b* can be located at the inner surface 20*a* where the gas supply channels 38 meet a mixing section 52.

As illustrated, the one or more gas supply channels 38 reduce the volume of space available for the pressurized gas in comparison with buffer space 50, which increases the velocity of the pressurized gas as the pressurized gas passes from the buffer space 50 through the one or more gas supply channels 38. This increase in velocity via reduction in volume assists in atomizing the material flowing through mixing section 52 into a spray when dispensed from outlet 48.

In the illustrated embodiment, one or more gas supply channel 38 is inclined or angled with respect to longitudinal axis A, for example, at approximately 45 degrees with respect to longitudinal axis A. Those of ordinary skill in the art will recognize other configurations which enable one or more gas supply channel 38 to place the buffer space 50 in fluid communication with the mixing section 52. In an alternative embodiment, for example, one or more gas supply channel 38 can be oriented approximately perpendicular to longitudinal axis A or at any other angle with respect to longitudinal axis A. Based on the dimensions of the components of spray nozzle 10, for example, an optimal incline for angle $\alpha$ between the two or more gas supply channels axes 38' and the longitudinal axis A can be approximately 5 degrees, approximately 10 degrees, approximately 15 degrees, approximately 20 degrees, approximately 25 degrees, approximately 30 degrees, approximately 35 degrees, approximately 40 degrees, approximately 45 degrees, approximately 50 degrees, approximately 55 degrees, approximately 60 degrees, approximately 65 degrees, approximately 70 degrees, approximately 75 degrees, approximately 80 degrees, approximately 85 degrees, or approximately 90 degrees with respect to longitudinal axis A. In alternative embodiments, an optimal incline for angle $\alpha$ between the two or more gas supply channels axes 38' and the longitudinal axis A can be between approximately 0 and 10 degrees, between approximately 10 and 20 degrees, between approximately 20 and 30 degrees, between approximately 30 and 40 degrees, between approximately 40 and 50 degrees, between approximately 50 and 60 degrees, between approximately 60 and 70 degrees, between approximately 70 and 80 degrees, or between approximately 80 and 90 degrees with respect to longitudinal axis A. An advantage of inclining one or more gas supply channel 38 as shown and described is that pressurized gas passing from the buffer space 50 into the mixing section 52 is directed in a way to push material within the mixing section 52 toward the outlet 48.

As illustrated in FIG. 5, in this connection it should be noted that an angle α between the two or more gas supply channels axes 38' and the longitudinal axis A passing through the enlarged central section 36 can be selected in the range of 10 degrees to 70 degrees, preferably in the range of 15 degrees to 60 degrees, especially in the range of 20 degrees to 50 degrees. By inclining one or more gas supply channel 38 as disclosed, undesirable upstream back pressure can be eliminated or reduced.

The coupling of the first component 12 to the second component 14 creates the mixing section 52 between the separating wall 30 and the outlet 48. In the illustrated embodiment, the mixing section 52 includes an inlet 52*a* and an outlet 52*b*, with an at least substantially cylindrical outer shape between the inlet 52*a* and the outlet 52*b*. In an embodiment, the inlet 52*a* can be considered the location where the first flow passage 32 and the second flow passage 34 meet the mixing section 52 along longitudinal axis A, and the outlet 52*b* can be considered the location where the mixing section 52 then meets the beginning of the outlet 48, with at least one outer surface of the outlet 48 tapering radially outwardly from the outlet 52*b* of the mixing section 52 to the outlet opening 54. In an embodiment, at least one outer surface of the outlet 48 from at least one view continuously tapers from the mixing section 52 to the outlet opening 54. In an alternative embodiment, the separating wall 30 can be partially or fully included within the mixing section 52.

As illustrated, the mixing section 52 can be aligned with an outlet 38*b* of one or more gas supply channels 38, with the one or more gas supply channels 38 placing the mixing chamber 52 in fluid communication with the buffer space 50 such that pressurized gas flows from the buffer space 50, into the inlet 38*a* of one or more gas supply channel 38, out of the outlet 38*b* of the one or more gas supply channel 38, and into the mixing section 52. In the illustrated embodiment, the mixing section 52 is located between the separating wall 30 and the outlet 48 such that material passing around the separating wall 30 through the first flow passage 32 and the second flow passage 34 meets at the inlet 52*a* of the mixing section 52 as pressurized gas is supplied by one or more gas supply channels 38. Once mixed within the mixing chamber 52, the mixed material can exit the mixing section 52 at the outlet 52*b* and be dispensed from the spray nozzle 10 via the outlet opening 54 of outlet 48. The introduction of the pressurized gas in the illustrated manner can enable the pressurized gas and mixed material to be swirled and atomized within the mixing section 52, thus enabling the mixed material to be sprayed from the outlet 48 in an atomized mixed manner. The structure enables the mixed materials to be atomized, resulting in an improved and uniform spray.

In the illustrated embodiment, the second component 14 further includes a gas supply connector 70 in fluid communication with the buffer space 50. The gas supply connector 70 enables the spray nozzle 10 to connect to a connecting device 112. As illustrated in FIGS. 1 and 5, the gas supply connector 70 can include a passage 72 configured to place the buffer space 50 in fluid communication with a corresponding passage through the connecting device 112, thus enabling the buffer space 50 to receive, for example, pressurized gas from tank T via a pressurized gas hose 116 as shown in FIG. 1. In an embodiment, the pressurized gas from tank T can be varied between about 5 psi and 15 psi In the illustrated embodiment, the gas supply connector 70 is disposed generally at a right angle to the longitudinal axis A through the spray nozzle 10, but those of ordinary skill in the art can recognize other suitable configurations to enable attachment to a connecting device 112.

The gas supply connector 70 can include a first portion 73 with a first diameter DA and a second portion 74 with a second diameter DB, the second diameter DB being greater than the first diameter DA. Thus, the step up in diameter from the first portion 73 to the second portion 74 forms a shoulder 76. The first portion 72 can also include a stop member 78 to prevent the connecting device 112 from being inserted beyond a predetermined distance. A recess 80 can be formed between the stop member 78 and the shoulder 76.

The second portion 74 can include a seal member 82 around the exterior surface 84 thereof, if desired. The seal member 82 can be formed from the same material and at the same time as the spray nozzle 10, or the seal member 82 can be formed from rubber or another material and be added to any portion of the spray nozzle 10 or in between any portion of the spray nozzle 10 and the connecting device 112 to prevent pressurized gas from escaping. Alternatively, a seal can be formed on an inner surface of the connecting device 112 that interacts with the exterior surface 84.

FIG. 5 illustrates the connecting device 112 in the process of being connected to the gas supply connector 70 such that a supply of gas is placed in fluid communication with the buffer space 50. As illustrated, an outlet section 160 of the connecting device 112 can be sized and shaped to fit over the gas supply connector 70 such that the protrusions 162 and 164 are expanded radially outwardly. Once the gas supply connector 70 is fully inserted into the connecting device 112, the protrusions 162 and 164 are biased radially inwardly and project into the recess 80 between the shoulder 76 and the stop member 78 of the gas supply connector 70. Once projected into the recess 80, the shoulder 76 prevents the connecting device 112 from disengaging the gas supply connector 70 unless a user squeezes the wings 166 and 168 radially inwardly to release the protrusions 162 and 164 from the recess 80.

In the illustrated embodiment, the buffer space 50 is the only buffer space within the spray nozzle 10 that is configured to hold pressurized gas received via the gas supply connector 70 prior to the pressurized gas passing through one or more gas supply channel 38 and into the mixing section 52. In an alternative embodiment, additional buffer spaces can be provided.

Referring now to FIG. 3, when the spray nozzle 10 is fully assembled, longitudinal axis A passes directly through the center of the spray nozzle 10 such that the flow of material along longitudinal axis A is only interrupted by the separating wall 30. In other words, the longitudinal axis A intersects with the separating wall 30, specifically with the longitudinal axis A intersecting the enlarged central section 36 of the separating wall 30. Beginning at the second end 24 of the first component 12, longitudinal axis A extends from the inlet 28, through the passage 26, through the enlarged central section 36 of the separating wall 30, through the mixing section 52, and out of the outlet 48. Further, in the illustrated embodiment, two gas supply channels 38 are aligned laterally with longitudinal axis A (see FIG. 6, e.g., located in the same lateral plane as longitudinal axis A from side view), and two gas supply channels 38 are aligned longitudinally with longitudinal axis A (see FIG. 5, e.g., located in the same longitudinal plane as longitudinal axis A from top view).

In this connection it should be noted that aligned means that the gas supply channels 38 are arranged in such a way relative to the enlarged central section 36 such that imaginary axes passing through each of these elements intersect in a common region, preferably at a common point.

The first component 12 and/or the second component 14 can be formed by any suitable material by any suitable method known in the art, for example, by 3D printing, injection molding, or other suitable methods. In an embodiment, each of the first component 12 and/or the second component 14 can be of single piece design and plastic. Alternatively, the spray nozzle can be of single piece design. Although the spray nozzle 10 is described herein as being formed of two parts (the first component 12 and the second component 14), it should be understood by those of ordinary skill in the art that the spray nozzle 10 can be formed in as many pieces as desired and be formed from any suitable material.

In an embodiment, the spray nozzle 10 (including the first component 12 and/or the second component 14) can be 3D printed using a 3D printer. 3D printing refers to a process in which material is joined or solidified under computer control to create a three-dimensional object, with material being complied to form the desired object. In some embodiments, a computer can refer to a smart phone, a tablet, a printer motherboard, a processor/computer in the printer, or any other device with a processor or an electronic controller. The material for the spray nozzle 10 can be any material, such as liquid molecules or powder grains being fused together. In some embodiments, the spray nozzle 10 can be printed from one or more materials such as PA12, polypropylene, and/or glass filled polyamide. However, the material can be any suitable material or materials.

The use of 3D printing can also enable the use of additional shapes and sizes of components besides those described herein. As explained above, for example, the use of a tapering bullet-like shape at the tip of the enlarged central section 36 can cause the material flowing through the passage 26 to form a donut shape as it passes into the first flow passage 32 and the second flow passage 34. Through the use of 3D printing, various alternative geometries of the enlarged central section 36 can be used to cause the flow of the material to take the donut shape or other shapes, thus reducing the cross-section of the material through the passage 26, increasing the surface area and/or the velocity through the first flow passage 32 and the second flow passage 34, and/or enabling the use of less air pressure from one or more gas supply channels 38 to properly atomize the material at mixing section 52.

In an embodiment, the first component 12 and/or the second component 14 can be a 2K injection molded part, be 3D printed and/or can have a plastic material having a shore D hardness selected in the range of 50 to 80.

In operation, the spray nozzle 10 can be attached to the dispenser D, for example, by sliding a mixing device 114 into or around the second end 24 until mating with a mating feature 60 and/or abutting a shoulder 66 formed on the inner surface 20*a* of the first outer wall 20. At the same time, a connecting device 112 can be connected to the gas supply connector 70 such that a supply of gas is placed in fluid communication with the buffer space 50 as described above. Upon activation of the trigger of dispenser D, the pressurized gas from the tank T can apply pressure to the piston 142, which in turn moves the shuttles 144*a* and 144*b*. The shuttles 144*a* and 144*b* compress the ends of the cartridges 132, which push the compounds out of the outlets into the mixing device 114. Mixing elements in the mixing device 114 can mix the compounds. The mixed compound can then exit the mixing device 114 and enter the spray nozzle 10 at the inlet 28 before being divided by the separating wall 30 into the first flow passage 32 and the second flow passage 34. Simultaneously or substantially simultaneously, the pressurized gas passes through the gas line 138, the hose 116 and the connecting device 112 and enters the buffer space 50 of the spray nozzle 10 via the gas supply connector 70. The pressurized gas then passes through one or more gas supply channel 38 into the mixing section 52 and mixes the separated flows of material from the first flow passage 32 and the second flow passage 34 prior to the material being dispensed by the spray nozzle 10 via the outlet 48.

The embodiments described herein provide an improved spray nozzle that creates a uniform cone spray which is easy to directionally control and apply to a surface, particularly at the edges of the surface without applying the material to an adjacent surface. The improved spray nozzle is configured to operate with high flow rates of material and cause little to no overspray, enabling efficient and uniform application of sprayable material to a large area. It should be understood that various changes and modifications to the spray nozzle described herein will be apparent to those skilled in the art and can be made without diminishing the intended advantages,

General Interpretation of Terms

In understanding the scope of the present invention, the term "comprising" and its derivatives, as used herein, are intended to be open ended terms that specify the presence of the stated features, elements, components, groups, and/or steps, but do not exclude the presence of other unstated features, elements, components, groups, integers and/or steps. The foregoing also applies to words having similar meanings such as the terms, "including", "having" and their derivatives. Also, the terms "part," "section," or "element" when used in the singular can have the dual meaning of a single part or a plurality of parts. Accordingly, these terms, as utilized to describe the present invention should be interpreted relative to a connecting device.

The term "configured" as used herein to describe a component, section or part of a device can include any hardware that is constructed to carry out the desired function unless otherwise specified.

While only selected embodiments have been chosen to illustrate the present invention, it will be apparent to those skilled in the art from this disclosure that various changes and modifications can be made herein without departing from the scope of the invention as defined in the appended claims. For example, the size, shape, location or orientation of the various components can be changed as needed and/or desired. Components that are shown directly connected or contacting each other can have intermediate structures disposed between them. The functions of one element can be performed by two, and vice versa. The structures and functions of one embodiment can be adopted in another embodiment. It is not necessary for all advantages to be present in a particular embodiment at the same time. Every feature which is unique from the prior art, alone or in combination with other features, also should be considered a separate description of further inventions by the applicant, including the structural and/or functional concepts embodied by such features. Thus, the foregoing descriptions of the embodiments according to the present invention are provided for illustration only, and not for the purpose of limiting the invention as defined by the appended claims and their equivalents.

What is claimed is:

1. A spray nozzle for spraying material, the spray nozzle comprising:

a first component having an inlet for the material, an end with an opening, and a separating segment proximal to the opening in the end of the first component;

a second component having an outlet, the second component being coaxially aligned with the first component;

a mixing section in fluid communication with the outlet, the inlet being in fluid communication with the mixing section, such that a flow of the material is capable of flowing in a flow direction from the inlet to the mixing section; and a buffer space for pressurized gas, the buffer space being in fluid communication with the mixing section via two or more separate gas supply channels, the inlet of first component comprising a separating wall configured to divide the flow of material to be sprayed into two separate longitudinally extending flow passages, the separating wall comprising an enlarged section disposed in the separating segment at the opening in the end of the first component, and being disposed prior to entry into the mixing section in the flow direction so as to divide the flow of the material into the two separate longitudinally extending flow passages prior to entering the mixing section, and the separating wall being aligned with the two or more gas supply channels, such that a longitudinal axis of the spray nozzle, which passes through the separating wall and gas supply channel axes which extend through each separate gas supply channel intersect within a common region, the gas supply channels being separate channels that each have an outlet at the outlet of the second component.

2. The spray nozzle according to claim 1, wherein the enlarged section is an enlarged central section.

3. The spray nozzle according to claim 2, wherein the enlarged central section of the separating wall is aligned with the two or more separate gas supply channels.

4. The spray nozzle according to claim 2, wherein the spray nozzle includes a longitudinal axis extending between the inlet, the mixing section and the outlet of the second component, and the enlarged central section of the separating wall and the two or more separate gas supply channels are aligned with the longitudinal axis.

5. The spray nozzle according to claim 2, wherein the enlarged central section has an at least substantially cylindrical outer shape.

6. The spray nozzle according to claim 2, wherein the enlarged central section is at least substantially bullet shaped.

7. The spray nozzle according to claim 2, wherein the separating wall includes two webs extending between a wall surrounding the inlet and the enlarged central section.

8. The spray nozzle according to claim 1, wherein the separating wall is aligned with the two or more separate gas supply channels.

9. The spray nozzle according to claim 1, wherein the spray nozzle includes a longitudinal axis extending between the inlet, the mixing section and the outlet of the second component, and the separating wall and the two or more separate gas supply channels are aligned with the longitudinal axis.

10. The spray nozzle according to claim 9, wherein the two or more separate gas supply channels are inclined with respect to the longitudinal axis.

11. The spray nozzle according to claim 1, wherein the mixing section has an at least substantially cylindrical outer shape between the outlet of the second component and the inlet.

12. The spray nozzle according to claim 1, wherein the outlet of the second component includes an outlet opening having an elongate shape with an elongate extent.

13. The spray nozzle according to claim 12, wherein the outlet of the second component tapers from the outlet opening to the mixing section.

14. The spray nozzle according to claim 13, wherein the outlet of the second component continuously tapers in size between the outlet opening and the mixing section.

15. The spray nozzle according to claim 12, wherein the separating wall is arranged transverse to the elongate extent of the outlet opening.

16. The spray nozzle according to claim 1, wherein the separating wall is arranged in a plane and two of the two or more separate gas supply channels are arranged in the same plane as the separating wall.

17. The spray nozzle according to claim 1, wherein two of the two or more separate gas supply channels are arranged in a plane transverse to a plane in which the separating wall is arranged.

18. The spray nozzle according to claim 1, wherein the inlet is configured to receive a portion of an outlet from a static mixer.

19. The spray nozzle according to claim 1, wherein the buffer space is in fluid communication with a gas supply connector.

20. The spray nozzle according to claim 1, wherein the buffer space is the only buffer space for the pressurized gas.

21. The spray nozzle according to claim 1, wherein the first component is an inner component and the second component is an outer component, and the buffer space is disposed between the inner component and the outer component.

22. The spray nozzle according to claim 21, further including alignment ribs on at least one of an outer surface of the inner component and an inner surface of the outer component, the alignment ribs being configured to cooperate with at least one corresponding element on the other one of the inner component and the outer component.

23. The spray nozzle according to claim 21, wherein at least a part of each gas supply channel is formed by the inner component and the outer component.

* * * * *